US010309660B2

(12) United States Patent
Deivasigamani et al.

(10) Patent No.: US 10,309,660 B2
(45) Date of Patent: Jun. 4, 2019

(54) COMBINED HEATING SYSTEM CAPABLE OF BI-DIRECTIONAL HEATING

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 153 days.

(21) Appl. No.: 15/656,076

(22) Filed: Jul. 21, 2017

(65) Prior Publication Data

US 2017/0336080 A1 Nov. 23, 2017

Related U.S. Application Data

(62) Division of application No. 14/732,666, filed on Jun. 5, 2015, now Pat. No. 9,746,190.

(Continued)

(51) Int. Cl.
*F24D 3/08* (2006.01)
*F24D 19/10* (2006.01)

(Continued)

(52) U.S. Cl.
CPC ..... *F24D 3/08* (2013.01); *F24D 3/082* (2013.01); *F24D 19/1066* (2013.01);

(Continued)

(58) Field of Classification Search
CPC ..... F24D 3/08; F24D 3/082; F24D 19/1066; F24D 19/1069; F24D 2200/043;

(Continued)

(56) References Cited

U.S. PATENT DOCUMENTS 2,519,266 A * 8/1950 Main ..... F24D 19/1006 165/243
3,150,827 A * 9/1964 Mohn ..... F24D 19/1015 122/406.1

(Continued)

FOREIGN PATENT DOCUMENTS

CA 2954519 A1 * 10/2017 ..... F24H 1/22
EP 0543769 A1 * 5/1993 ..... F24D 10/00

(Continued)

*Primary Examiner* — Gregory L Huson
*Assistant Examiner* — Daniel E Namay
(74) *Attorney, Agent, or Firm* — Tracy Jong Law Firm; Tracy P. Jong; Cheng Ning Jong

(57) ABSTRACT

A combined heating system comprising a first heating subsystem including a first fluid conductor, a first heating unit adapted to heat a first fluid and output the first fluid at the outlet of the first fluid conductor, and a fluid mover adapted to move the first fluid through the first heating unit, a second heating subsystem including a second fluid conductor adapted to receive a second fluid, a third fluid conductor, a second heating unit adapted to heat the second fluid and output the heated second fluid in the third fluid conductor, a fluid mover adapted to move the second fluid from the outlet of the third fluid conductor to the inlet of the second fluid conductor, at least one heat exchanger operably connected to a downstream location of the first heating unit and a fourth fluid conductor connecting the second fluid conductor and the third fluid conductor.

7 Claims, 4 Drawing Sheets

Related U.S. Application Data

(60) Provisional application No. 62/008,536, filed on Jun. 6, 2014.

(51) Int. Cl.

| | |
|---|---|
| *F24D 11/00* | (2006.01) |
| *F24D 12/02* | (2006.01) |
| *F24D 17/00* | (2006.01) |
| *F24H 1/48* | (2006.01) |
| *F24H 1/22* | (2006.01) |

(52) U.S. Cl.
CPC .... *F24D 2200/043* (2013.01); *F24D 2200/08* (2013.01); *F24D 2200/32* (2013.01); *F24H 1/22* (2013.01)

(58) Field of Classification Search
CPC ..... F24D 2200/08; F24D 2200/32; F24D 11/002; F24D 12/02; F24D 17/0026; F24D 17/0089; F24H 1/22; F24H 1/14; F24H 1/48; F24H 1/52; Y02B 30/14
USPC .... 237/8 A, 8 D, 19, 62; 122/235.14, 13.01, 122/235.19, 406.3
See application file for complete search history.

(56) References Cited

U.S. PATENT DOCUMENTS

| | | | | |
|---|---|---|---|---|
| 3,341,122 | A * | 9/1967 | Whittell, Jr. | F24D 3/02 165/163 |
| 9,746,190 | B2 * | 8/2017 | Deivasigamani | F24D 3/08 |
| 2011/0135289 | A1 * | 6/2011 | Kayser | F24D 17/0031 392/449 |
| 2011/0219824 | A1 * | 9/2011 | Lee | D06F 39/008 68/5 C |
| 2012/0091214 | A1 * | 4/2012 | Rixen | F23N 3/08 237/5 |
| 2015/0013961 | A1 * | 1/2015 | Perrin | F24D 19/1012 165/298 |
| 2015/0300661 | A1 * | 10/2015 | Park | F24H 1/523 237/8 R |
| 2016/0116185 | A1 * | 4/2016 | Ryu | F24D 3/1091 122/448.3 |
| 2016/0341445 | A1 * | 11/2016 | Deivasigamani | F24H 1/08 |

FOREIGN PATENT DOCUMENTS

| | | | | |
|---|---|---|---|---|
| JP | 2015075256 | A * | 4/2015 | |
| WO | WO-2009096256 | A1 * | 8/2009 | F24D 3/082 |

* cited by examiner

COMBINED HEATING SYSTEM CAPABLE OF BI-DIRECTIONAL HEATING

PRIORITY CLAIM AND RELATED APPLICATIONS

This divisional application claims the benefit of priority from provisional application U.S. Ser. No. 62/008,536 filed on Jun. 6, 2014 and U.S. Ser. No. 14/732,666 filed on Jun. 5, 2015. Each of said applications is incorporated by reference in its entirety.

BACKGROUND OF THE INVENTION

1. The Field of the Invention

The present invention is directed generally to a combined heating system capable of bi-directional heating. More specifically, the present invention is directed to a combined domestic water and space heating system having shared heat exchangers capable of causing heat transfer from domestic water side to space heating side or from space heating side to domestic water side.

2. Background Art

Combined heating systems are commonly used in domestic water heating and space heating. Typically, a boiler is provided to a space heating flow loop, a domestic hot water storage tank is adapted to a domestic water flow loop and a heat exchanger powered by the same boiler is adapted to heat domestic water in the domestic hot water storage tank. The liquid stored in the domestic hot water storage tank is largely static as there is little flow that occurs around the heat exchanger due to the large volume of water held in the domestic hot water storage tank. The effective surface area for heat transfer is therefore relatively small. Further, heat transfer occurs only from the heat exchanger to the liquid stored in the hot water storage tank. In order to receive hot domestic water with little or no delay at the outlet of the hot water storage tank, the liquid stored in the hot water storage tank must be maintained at an appropriate temperature by the boiler which is also tasked to provide space heating. Therefore, in order to meet a large domestic hot water demand, a very large boiler or a group of boilers must be used as heat transfer from the heat exchanger is largely inefficient.

Thus, there is a need for a combined heating system capable of more efficient heating and capable of meeting domestic hot water and space heating without unduly large boilers.

SUMMARY OF THE INVENTION

In accordance with the present invention, there is provided a combined heating system comprising a first heating subsystem including a first fluid conductor having an inlet and an outlet, the first fluid conductor adapted to receive a first fluid at a first temperature at the inlet of the first fluid conductor, at least one heating unit adapted to heat a portion of the first fluid to a second temperature and output the portion of the first fluid at the outlet of the first fluid conductor, and a fluid mover adapted to move the portion of the first fluid through the at least one heating unit of the first heating subsystem, a second heating subsystem including a second fluid conductor having an inlet, the second fluid conductor adapted to receive a second fluid, a third fluid conductor having an outlet, at least one heating unit adapted to heat a portion of the second fluid at a third temperature received from the second fluid conductor and output the heated second fluid at a fourth temperature in the third fluid conductor, wherein the flowrate of the second fluid through the at least one heating unit of the second heating subsystem is configured to be controlled using a valve, a fluid mover adapted to move the second fluid from the outlet of the third fluid conductor to the inlet of the second fluid conductor, at least one heat exchanger operably connected to a downstream location of the at least one heating unit of the first heating subsystem and a fourth fluid conductor connecting the second fluid conductor and the third fluid conductor, wherein the flowrate of the second fluid through the fourth fluid conductor is configured to be controlled using a valve. If heating of any one of the first fluid and second fluid is desired, both the fluid mover of the first heating subsystem and the at least one heating unit of the first heating subsystem are turned on, both the fluid mover of the second heating subsystem and the at least one heating unit of the second heating subsystem are turned on or any combinations thereof.

In one embodiment, a present heating unit is a coil tube heater exchanger. In another embodiment, a present heating unit is an electric coil heat exchanger. In one embodiment, a present fluid mover is a pump.

In one embodiment, the first fluid and the second fluid include water and glycol.

In yet another embodiment, both the first fluid and the second fluid are water.

An object of the present invention is to provide an efficient combined domestic water and space heating system.

Another object of the present invention is to provide a combined domestic water and space heating system using shared hardware resources (heat exchangers) such that the total amount of equipment to serve both domestic water and space heating can be minimized.

Another object of the present invention is to provide a combined domestic water and space heating system using shared hardware resources (heat exchangers) such that that a shutdown in one or more heating units of any of the heating subsystems does not affect operations of the heating system as a whole, thereby allowing the system to continue to operate.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—combined heating system
4—heating unit (e.g., coil tube heat exchanger, electric coil heat exchanger, etc.)
6—fluid mover (e.g., pump, etc.)
8—heat exchanger (e.g., plate type, etc.)
10—inlet
12—outlet
14—inlet
16—outlet
18, 20—valve
22, 24, 26, 27—fluid conductor
28—first heating subsystem
30—second heating subsystem
32—first fluid
34—second fluid
36—hot water storage tank
38—boiler
40—pump
42—heating coil
44—domestic cold water input
46—domestic hot water output
48—space heating return line
50—space heating output line

Particular Advantages of the Invention

The present combined heating system provides a system for domestic water heating and space heating in a single system. The use of a present combined heating system allows a smaller total heating system to meet typical needs of domestic water and space heating. As space heating and hot domestic water may be required at different times, the ability to meet such requirements using a smaller number of dedicated heating units for each purpose becomes possible as some heating may be accomplished using shared heating units or even heating units dedicated for heating the other heating subsystem. The present combined heating system is capable of meeting small and large demands alike as heating units may be selectively turned on in various combinations.

The present combined heating system takes advantage of the use of flow movers to encourage heat transfer, replacing the use of an inefficient heat transfer system where heat is transferred to a large static volume of liquid from a small coil with forced flow of a heated liquid.

The present combined heating system mitigates a planned or unplanned shutdown of a dedicated heating unit by using one or more shared heating units or one or more dedicated heating units of the other heating subsystem. The present combined heating system provides backups not only from multiples of a type of heating unit (e.g., dedicated or shared), but also from cross heating of one heating subsystem with another heating subsystem.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
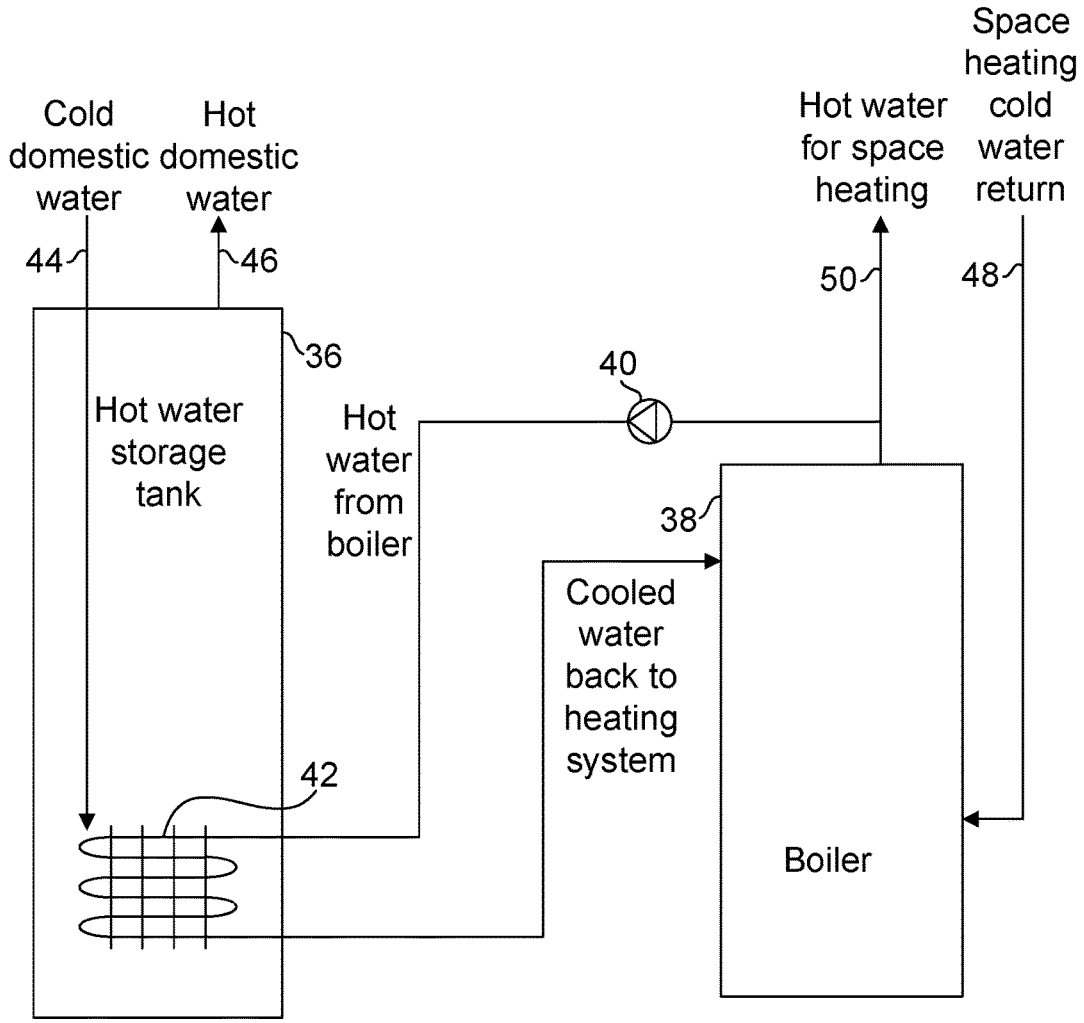
PRIOR ART FIG. 1
FIG. 1 is a diagram depicting a conventional combined domestic water and space heating system.

FIG. 1 is a diagram depicting a conventional combined domestic water and space heating system. A boiler is used to heat both a space heating loop and a domestic water supply in a hot water storage tank. If a large amount of heating is required, a very large boiler would be required of this type of heating system or a long delay for hot water will ensue. In contrast to this conventional combined heating system, the present combined heating system takes advantage of the use of flow movers to encourage heat transfer, replacing the use of an inefficient heat transfer system where heat is transferred to a large static volume of liquid held in a hot water storage tank from a small range, with forced flows of a heated liquid in a large boiler.

As will be disclosed elsewhere herein, the present combined heating system provides a system for domestic water heating and space heating in a single system. The use of a present combined heating system allows a smaller total heating system to meet typical needs of domestic water and space heating in residential, commercial or industrial applications. As space heating and hot domestic water may be required at different times, the ability to meet such requirements using a smaller number of dedicated heating units for each purpose becomes possible as some heating may be accomplished using shared heating units or even heating units dedicated for heating the other loop as will be disclosed elsewhere herein.

Figure 2:
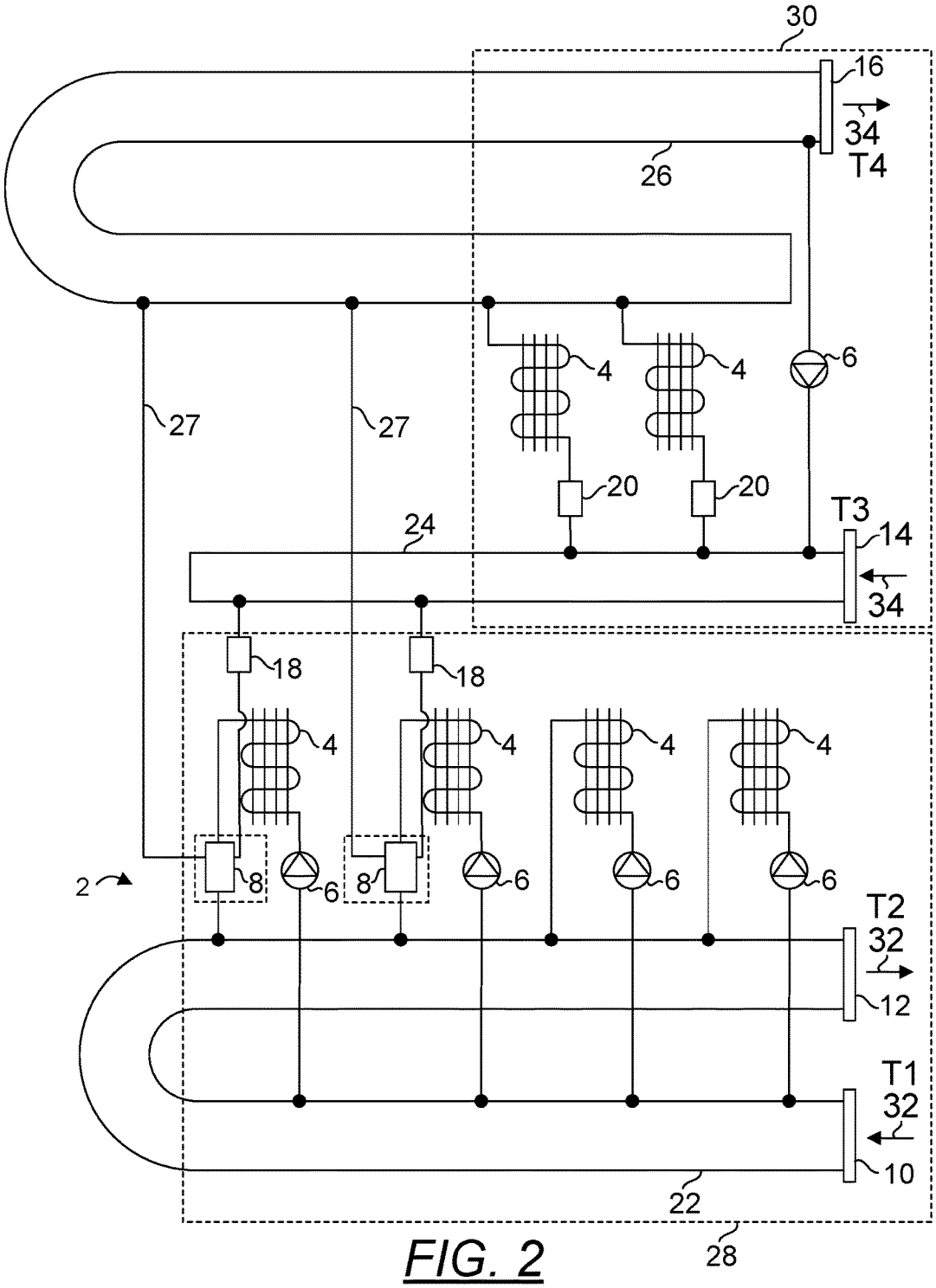
FIG. 2 is a diagram depicting one embodiment of the present combined heating system.

FIG. 2 is a diagram depicting one embodiment of the present combined heating system 2. There is provided a combined heating system 2 including a first heating subsystem 28, a second heating subsystem 30 and at least one heat exchanger 8. The first heating subsystem 28 includes a first fluid conductor 22 having an inlet 10 and an outlet 12, the first fluid conductor 22 adapted to receive a first fluid 32 at a first temperature T1 at the inlet of the first fluid conductor 22, at least one heating unit 4 adapted to heat a portion of the first fluid 32 to a second temperature T2 and output the portion of the first fluid at the outlet 12 of the first fluid conductor 22, and a fluid mover 6 adapted to move the portion of the first fluid through the at least one heating unit 4 of the first heating subsystem 28. In the embodiment shown in FIG. 2, there are four heating units 4 in the first heating subsystem 28.

The second heating subsystem 30 includes a second fluid conductor 24 having an inlet 14, the second fluid conductor 24 adapted to receive a second fluid 34, a third fluid conductor 26 having an outlet 16, at least one heating unit 4 adapted to heat a portion of the second fluid 34 at a third temperature T3 received from the second fluid conductor 24 and output the heated second fluid 34 at a fourth temperature T4 in the third fluid conductor 26. If necessary, a fluid mover 6 can be adapted to move the second fluid 34 from the outlet 16 of the third fluid conductor 26 to the inlet 14 of the second fluid conductor 24. In the embodiment shown in FIG. 2, there are two heating units 4 in the second heating subsystem 30. It shall be noted that, each of the heating units 4 receives a fluid to be heated from a portion of a fluid conductor or reservoir that is rather large compared to the amount of fluid held in the conductor of the heating unit 4, adds heat to the rather small amount of fluid held in the conductor and empties the heated fluid into another portion of the fluid conductor or a portion of another conductor, thereby causing mixing of this now heated water in the rest of the fluid in the reservoir or conductor. In the present combined heating system, a large volume contained in any of the conductors 22, 24, 26 can therefore be heated more effectively due to mixing of heated water as driven by a fluid mover 6 and unheated water contained in the conductors 22, 24, 26. In the embodiment shown in FIG. 2, the first fluid conductor 22 is configured in a "U" shape. A U-shaped conductor allows a rather long and narrow conductor to be accommodated in a space that is often taken up by tank heaters. A long and narrow conductor is afforded increased surface areas for enhanced heat transfer. Cold fluid is drawn from a first arm of the U-shaped conductor, heated and emptied into a second arm of the U-shaped conductor. In the embodiment shown in FIG. 2, the third fluid conductor 26 is also U-shaped. Spent fluid is first drawn into the second fluid conductor 24. This fluid either absorbs heat or rejects heat via a heat exchanger 8 and/or receives heat from a heating unit 4 before getting emptied in the third fluid conductor 26. The fluid contained in the third fluid conductor 26 may be cycled back to the second fluid conductor 24. Although each of fluid conductors 22, 24, 26 is rather large and capable of servicing a large domestic water and space heating needs, delays in receiving heated fluid is reduced as there are provided multiple heating units 4 which can be turned on simultaneously should large demands are received. Further, the amount of surface area of a fluid flow that is exposed to a heating unit is rather large as the fluid contained in the large fluid conductors 22, 24, 26 is heated in small conductors of heating units 4 (with large heat transfer surface area) rather than a large conductor that is heated with one or more heating sources disposed on the outside surface of the large conductor as in the case of conventional tank heaters.

At least one heat exchanger 8 is operably connected to a downstream location of the at least one heating unit 4 of the first heating subsystem 28 and a fourth fluid conductor 27 connecting the second fluid conductor 24 and the third fluid conductor 26.

Figure 3:
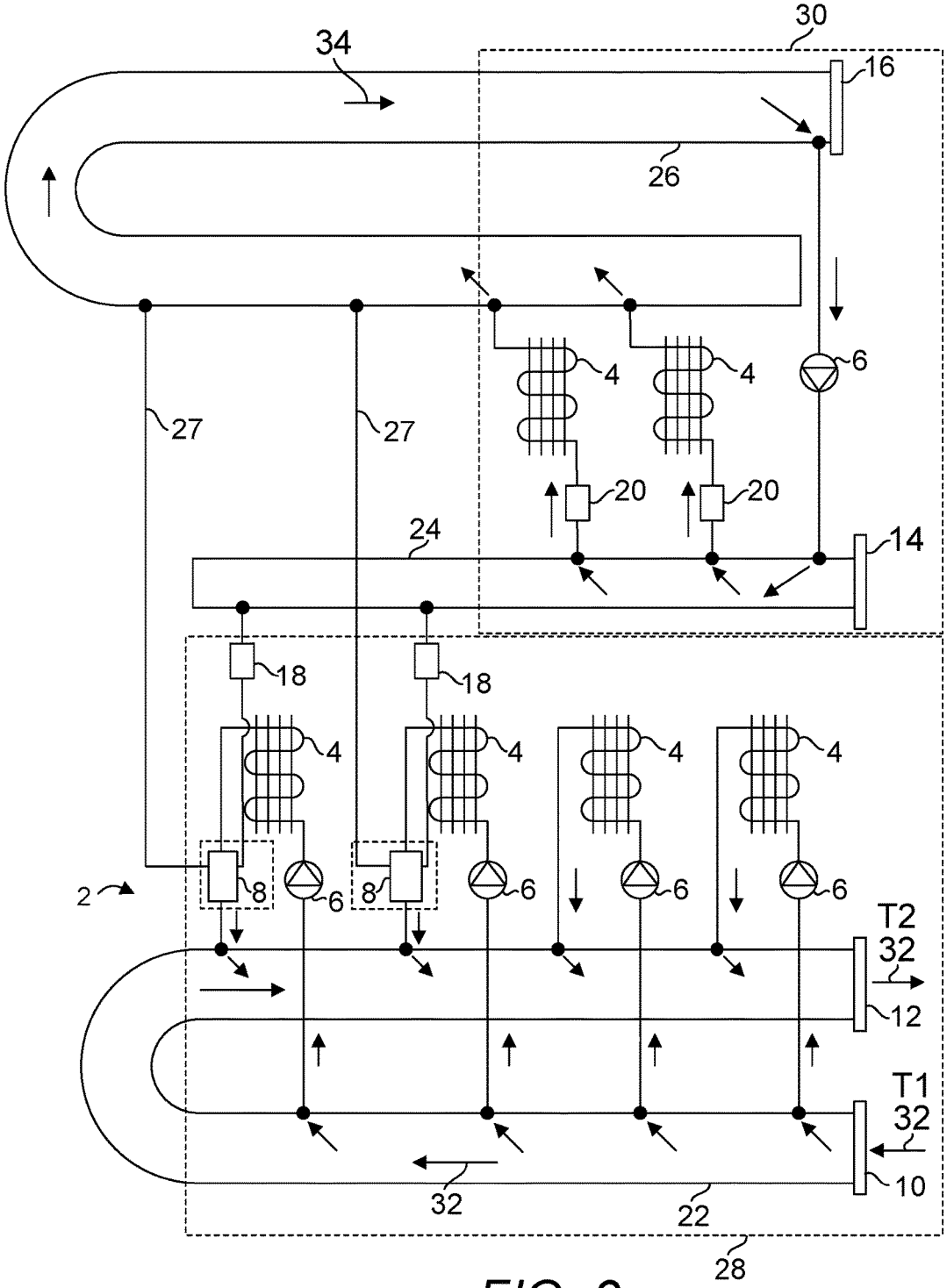
FIG. 3 is a diagram of one embodiment of the present combined heating, depicting the fluid flows in both the first and second heating subsystems when the second fluid in the second heating subsystem is being prepared in anticipation of being used to heat the first fluid via the heat exchangers.
Figure 4:
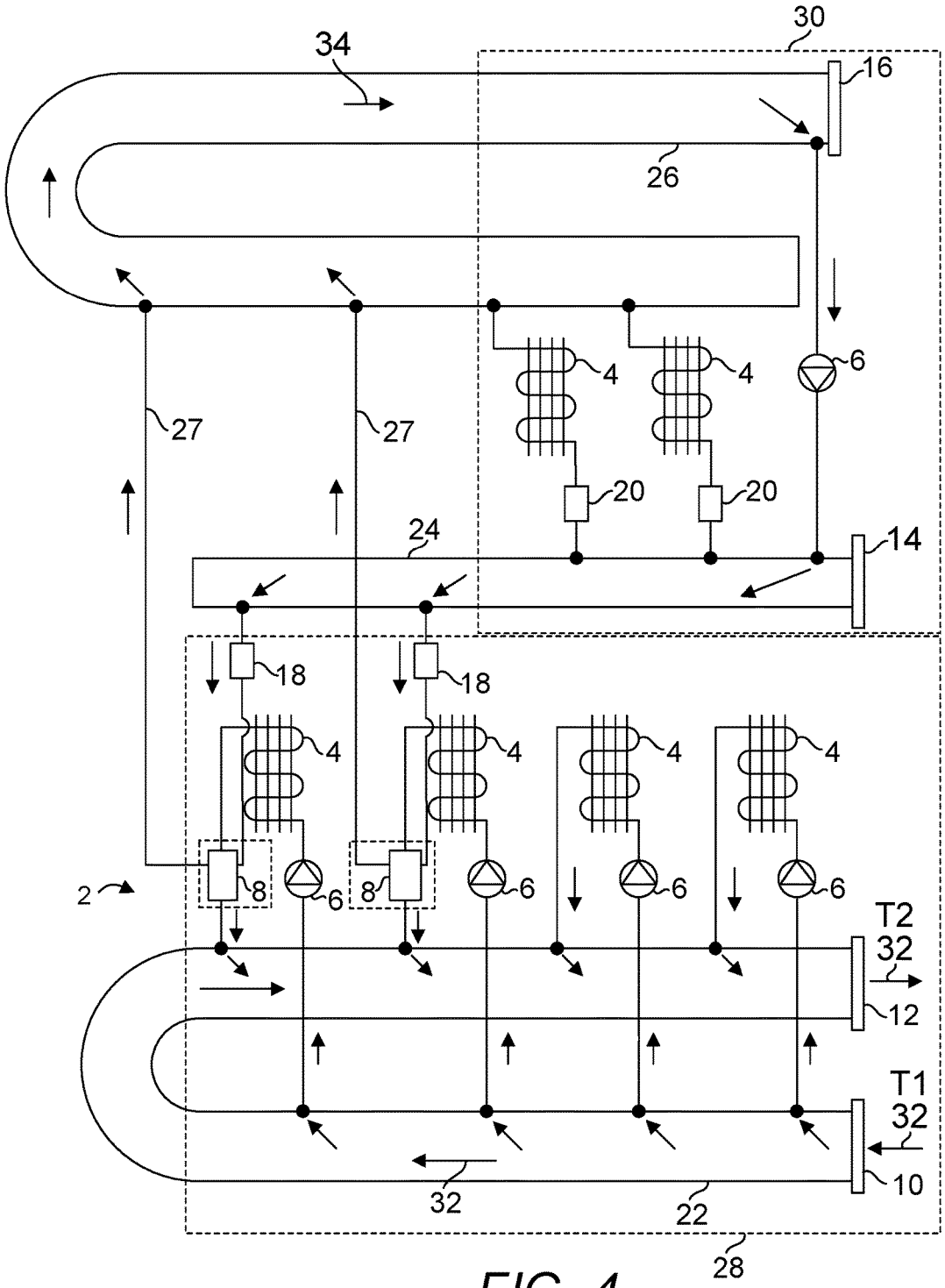
FIG. 4 is a diagram of one embodiment of the present combined heating, depicting the fluid flows in both the first and second heating subsystems when the second fluid in the second heating subsystem has already been prepared and is being used to heat the first fluid via the heat exchangers.

Heating of one or both of the fluids 32 and 34 can be effected in the following ways. If heating of the first fluid 32 is desired, the heating units 4 and the fluid movers 6 of the first heating subsystem 28 can be turned on. Either or both groups of the heating units 4 directly connected to the heat exchangers 8 or the heating units 4 not directly connected to the heat exchangers 8 may be used. If one or more groups directly connected to the heat exchangers 8 are used and heating of the second fluid 34 is not desired, valves 18 are preferably closed. If enhanced heating of the first fluid 32 is desired, the second heating subsystem 30 may be first turned on with one or more of its heating units 4 adding heat to the second fluid even without a demand of the second fluid 34. The fluid flows involved in enhancing heating of the first fluid is shown in FIG. 3. Upon receiving heated second fluid 34, the valves 20 and the heating units 4 of the second heating subsystem 30 are closed and deactivated, respectively and the second fluid 34 is forced to flow through the heat exchanger 8 with valves 18 now open. FIG. 4 is a diagram of one embodiment of the present combined heating, depicting the fluid flows in both the first and second heating subsystems 28, 30 when the second fluid 34 in the second heating subsystem 30 has already been prepared and is being used to heat the first fluid 32 via the heat exchangers 8.

It shall be apparent now that the heating of the second fluid 34 can be used to heat the first fluid 32. Such arrangement is especially useful when a high heating rate is required of the first fluid 32 while no demand of the second fluid 34 exists. This way, heat addition from the heating units 4 of the second heating subsystem 30 can occur concurrently with heat addition from the heating units 4 of the first heating subsystem 28. The heat exchanger 8-coupled heating units 4 may be left off or turned on simultaneously to heat the first fluid 32. If the heat exchanger 8-coupled heating units 4 are turned on, care must be taken to ensure that a temperature gradient which favors the transfer of heat from the second fluid 34 to the first fluid 32 if the second heating subsystem 30 is currently turned on with valves 18 at least partially open or the heat generated in the heat exchanger 8-coupled heating units 4 will be inadvertently transferred to the second fluid 34 from the first fluid 32. In one example, the heated second fluid 34 (at 180 degrees Fahrenheit) is configured to "give up" some of its heat to the first fluid 32 via a heat exchanger 8. Upon flowing through a heat exchanger 8, the heated second fluid 34 experiences a drop in temperature from about 180 degrees Fahrenheit to about 130 degrees Fahrenheit while the first fluid 32 is heated from about 125 degrees Fahrenheit to about 175 degrees Fahrenheit.

A condition can also exist where the heating units 4 dedicated for the first fluid 32 (or heating units of the first heating subsystem which are not directly connected to the heat exchangers 8) and the heating units 4 directly connected to the heat exchangers 8 may be removed for service and temporarily replaced with non-heating elements. Under this condition, heating of the first fluid 32 may be carried out solely using the heating units 4 for the second fluid 34. Alternatively, valves 20 may be partially closed only with the heating units 4 still turned on. When a demand for the second fluid 34 exists, the fluid mover 6 of the second heating subsystem 30 is closed causing the entire second fluid flow to exit the second heating subsystem 30 via outlet 16. Valves 18 can alternatively be closed or restricted further if enhanced heating of the second fluid 34 is now desired. Alternatively but less desirably, the first fluid 32 may be heated solely with the heating units 4 of the second heating subsystem 30. In one embodiment, at least one of the heat exchangers 8 is a plate-type heat exchanger. In another embodiment, at least one of the heat exchangers 8 is a shell and tube heat exchanger. In order to further illustrate the means by which the first and second heating subsystems 28, 30 can be used cooperatively, the following example is provided. In one example, the first conductor 22 represents a portion of a space heating loop and the second 24 and third 26 conductors represent a portion of a domestic water line. Each of the pumps 6 of the heating units 4 directly connected to heat first heating subsystem 28 is adapted to push large flows, e.g., from about 15 to about 20 Gallons Per Minute (GPM), thus increasing the temperature of outlet 12 from only from about 100 degrees Fahrenheit at inlet 10 to about 125 degrees Fahrenheit.

If enhanced heating of the second fluid 34 is desired, the heating units 4 connected to the heat exchangers 8 may be first turned on with these heating units 4 transferring heat generated in these heating units 4 to the second fluid 34 of the second heating subsystem 30 via heat exchangers 8. If such heating is desired, a flow must be effected through valve/s 18. This is possible only if valve/s 18 is/are at least partially open. In order to force adequate flow through valve/s 18 with valve/s fully open, the fluid mover 6 of the second heating subsystem 30 would have to have a very high capacity or valve/s 20 may be partially or fully restricted to encourage flow through valve/s 18 with a smaller and more reasonably sized fluid mover 6. In one embodiment, the second fluid 34 is heated from about 120 degrees Fahrenheit to about 180 degrees Fahrenheit through the dedicated heating units 4 of the second heating subsystem 30. It shall be noted that it has now been disclosed a combined heating system for domestic water and space heating where heat transfer can be effected from the portion responsible for domestic water heating to the portion responsible for space heating and vice versa, therefore making the combined system capable of bi-directional heating. Further, the combined system is capable of capturing waste heat. For instance, after the first and second heating subsystems have been active simultaneously for an extended period of time and one of the two subsystem is no longer needed (e.g., due to the satisfaction of achieving a setpoint temperature in a space heating scenario), the residual heat contained in one subsystem may be transferred to the other subsystem provided that there exists an appropriate temperature gradient between the two subsystems to encourage appropriate heat transfer.

In one embodiment, a present heating unit is a coil tube heater exchanger. In another embodiment, a present heating unit is an electric coil heat exchanger. In one embodiment, a present fluid mover is a pump.

In one embodiment, the present invention is to provide an efficient combined domestic water and space heating system. In one embodiment, the first fluid is domestic water and the second fluid is glycol. In another embodiment, the first fluid is glycol and the second fluid is domestic water. In yet another embodiment, both the first and second fluids are water.

In one embodiment, the present invention is to provide a combined domestic water and space heating system using shared hardware resources (heat exchangers) such that the total amount of equipment to serve both domestic water and space heating can be minimized. As demonstrated elsewhere herein, the first fluid 32 can be heated not only with dedicated heating units of the first heating units but also shared heating units and/or heating units of the second heating units. By the same token, the second fluid 34 can be heated not only with dedicated heating units of the second heating units but also shared heating units and/or heating units of the first heating units.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A heating system for heating a fluid, said heating system comprising:

(a) a U-shaped fluid conductor comprising a first arm comprising an inlet and an outlet and a second arm comprising an inlet and an outlet, said first arm is configured for receiving the fluid at said inlet of said first arm and channeling the fluid to exit said first arm at said outlet of said first arm and said second arm is configured for receiving the fluid from said outlet of said first arm and emptying the fluid through said outlet of said second arm; and (b) at least one heating unit functionally coupled with a fluid mover, said at least one heating unit is configured to receive a portion of the fluid through said first arm at a location between said inlet and outlet of said first arm, add heat to the portion of the fluid to produce a heated fluid and return the heated fluid into said second arm at a location between said inlet and outlet of said second arm, wherein the heated fluid is emptied into said second arm to heat the fluid.

2. The heating system of claim 1, wherein at least one of said at least one heating unit comprises a heat exchanger selected from the group consisting of a coil tube heater exchanger and electric coil heat exchanger.

3. The heating system of claim 1, wherein said fluid mover is a pump.

4. The heating system of claim 1, wherein said at least one heating unit is functionally coupled to a heat exchanger.

5. The heating system of claim 4, wherein said heat exchanger is a plate-type heat exchanger.

6. The heating system of claim 4, wherein said heat exchanger is a shell and tube type heat exchanger.

7. The heating system of claim 1, wherein the fluid is water.

* * * * *